United States Patent [19]

Kurusu

[11] Patent Number: 4,655,455

[45] Date of Patent: Apr. 7, 1987

[54] SPORTS RACKETS

[76] Inventor: Shozo Kurusu, 109 Stratford Pl., Charleston, W. Va. 25303

[21] Appl. No.: 741,212

[22] Filed: Jun. 5, 1985

[51] Int. Cl.[4] ..... A63B 49/02

[52] U.S. Cl. ..... 273/73 C

[58] Field of Search ..... 273/73 R, 73 C, 73 D, 273/73 E, 73 H, 73 L, 73 F, 73 E, 73 G, 73 K; D21/212

[56] References Cited

U.S. PATENT DOCUMENTS

| | | | |
|---|---|---|---|
| 1,179,435 | 4/1916 | Hutchinson | 273/73 L |
| 1,502,845 | 7/1924 | Blache | 273/73 D |
| 1,637,583 | 8/1927 | Norton | 273/73 D |
| 3,968,966 | 7/1976 | D'Aquanni | 273/73 D |
| 4,076,241 | 2/1978 | Newsome | 273/73 D |
| 4,094,505 | 6/1978 | Beall, Jr. | 273/73 C |
| 4,139,194 | 2/1979 | Fischer | 273/73 C |
| 4,189,142 | 2/1980 | De Vries | 273/73 D |
| 4,196,901 | 4/1980 | Durbin | 273/73 G |
| 4,322,076 | 3/1982 | Bertram et al. | 273/73 D |
| 4,346,891 | 8/1982 | Epstein | 273/73 C |

FOREIGN PATENT DOCUMENTS

| | | | |
|---|---|---|---|
| 1050581 | 3/1979 | Canada | 273/73 R |

*Primary Examiner*—Richard C. Pinkham
*Assistant Examiner*—Matthew L. Schneider
*Attorney, Agent, or Firm*—Lowe, Price, Leblanc, Becker & Shur

[57] ABSTRACT

A sports racket having a head including a first frame within which is strung plural string elements interconnected to form a ball-engaging surface on each face of the racket, further comprises a second frame formed with a hand grip and first and second frame arms projecting outward therefrom. Each first and second frame arm has two welded points of connection with the first frame located respectively at upper and lower portions of the racket head. Upon impact of a ball with the string surface, impact force is transmitted to the second frame through the points of connection, permitting the racket head to flex between the points of connection so that the string surface remains generally parallel to the hand grip for improved controllability of the ball.

6 Claims, 6 Drawing Figures

SPORTS RACKETS

TECHNICAL FIELD

The present invention relates to rackets and, more particularly, to a racket construction having an enlarged power zone or sweet spot providing greater controllability over the ball.

BACKGROUND ART

Conventional tennis rackets typically have a plurality of main and cross strings interwoven within a frame to form a racket head having a generally flat ball-engaging surface. The head is connected to a shaft provided with a hand grip. A forward end of the shaft adjacent the head is sometimes reinforced with a pallet.

With the aforesaid conventional racket, the head is secured in a cantilevered manner to the grip, and includes a sweet spot or power zone located in the lower portion of the ball-engaging surface and extending generally from the surface center towards the shaft. In using the racket, it is desirable for a player to hit the ball by contact with the sweet spot in order to generate more power and greater stability and control over the ball. However, because of the small size of the sweet spot, and the fact that many players hit the ball nearer the frame towards the top of the head and outside the sweet spot, the racket tends to twist in the player's hand causing the ball to be misguided.

To enlarge the sweet spot, it is known from U.S. Pat. No. 4,076,241 to modify the main and cross strings within an otherwise conventional racket head and frame so that the string elements are connected to provide substantially concave ball-engaging surfaces on each face. Interweaving the strings in the aforesaid manner would appear to be more costly in relation to prior art string configurations. Also, when stringing a wooden frame, upper or lower surfaces thereof must initially be formed with a slight taper or slope to enhance the slope or inclination of the strings.

Another racket described for providing greater controllability of the ball is disclosed in U.S. Pat. No. 4,094,505 wherein parallelism between the head and grip of the racket is maintained by a two-part shaft having flexible pivot connections between one shaft part extending between the grip and inner end of the head and the other part extending between the grip and outer end of the head. This arrangement appears to be costly in view of the manufacturing requirement of a two-part shaft with pivot connections to the racket head.

It is accordingly one object of the present invention to provide an improved sports racket having an enlarged sweet spot or power zone tending to impact with the ball with greater frequency during play for improved control over the ball.

Another object of the invention is to provide a sports racket having an improved and economical frame construction that enlarges the sweet spot to extend from the lower to upper portion of the head and completely encompass the center portion of the string surface.

Still another object is to provide a sports racket of improved cantilever construction whereby the string face defining the sweet spot remains substantially parallel to the grip upon impact with the ball, while permitting the racket head to flex for increased power without loss of control over the ball.

SUMMARY OF THE INVENTION

A sports racket for playing tennis and the like, in accordance with the present invention, comprises a racket head having a first frame containing plural transversely and longitudinally extending strings mounted within and connected to the first frame to form a ball-engaging surface on each face of the racket. A second frame is provided with a hand grip and first and second frame arms projecting outward therefrom. Each first and second frame arm respectively has two points of connection with the first frame, located respectively at upper and lower portions of the racket head. The first and second frames establish an enlarged sweet spot extending from a lower to upper portion of the string surface by distributing impact force to upper and lower parts of the second frame while permitting the racket head to flex between the connection points upon impact with the ball while allowing the string surface to remain generally parallel to the hand grip for improved controllability over the ball.

The first and second points of connection are preferably rigid connections such that portions of the first frame at the points of connection are immovable in relation to portions of the first and second frame arms at the respective points of connection. These points of connection can be formed by welding the first frame constituting the racket head to the first and second frame arms.

In one embodiment of the invention, each first and second frame arm, between their respective points of connection with the first frame, includes upper and lower frame members extending respectively, in juxtaposed relation to each other, above and below lateral areas of the string surface in inwardly spaced relation to the racket head.

Associated upper and lower frame members are formed integral each other and connected together by a web portion extending through the plane of the string surface. The web portion includes a series of string receiving slots elongated in a direction perpendicular to the plane of the string surface. In response to contact during play between a ball and the enlarged sweet zone, the first frame is permitted to flex and bow outwardly from the plane of the second frame with the plane of the string surface remaining generally parallel to and spaced from the plane of the second frame by unimpeded movement of the strings through these slots.

In another embodiment of the invention, the first and second frame arms, between their respective points of connection with the first frame, extend and are bowed outward from the first frame.

Additional objects, advantages and novel features of the invention will be set forth in detail in part in the description which follows and in part will become apparent to those skilled in the art upon examination of the drawings, or may be learned by practice of the invention. The objects and advantages of the invention may be realized and obtained by means of the instrumentalities and combinations particularly pointed out in the appended claims.

BEST MODE FOR CARRYING OUT THE INVENTION

Figure 1:
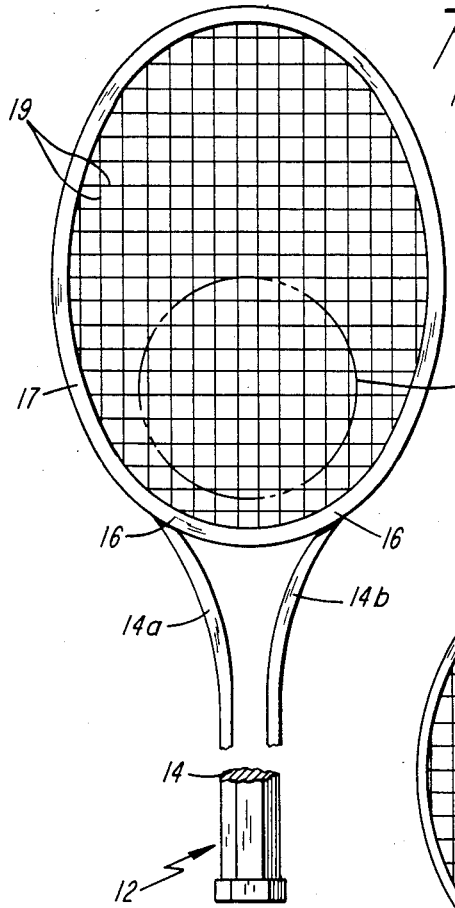
FIG. 1 PRIOR ART
FIG. 1 is a front view of a conventional tennis racket and the sweet spot formed on a string surface thereof.

Referring to prior art FIG. 1, a conventional racket 10 comprises a hand grip 12 connected to one end of a racket shaft portion 14. Opposite bifurcated ends 14*a* and 14*b* project outward from shaft 14 for attachment at two points of connection 16 to a lower portion of a frame 17 defining a racket head 18. A plurality of longitudinal and transverse string elements 19 are strung within frame 17 to form a ball-engaging surface on each face of racket 10.

The racket head 18 is cantilevered to hand grip 12 at connection points 16. During play, as a ball strikes the string surface, head 18 deflects (i.e., bends) in the direction of ball travel with a greater degree of deflection occurring at the upper portion of the racket head located above sweet spot 20. In other words, the plane of the string surface above spot 20 undergoes deflection upon impact with the ball such that it is no longer parallel to the longitudinal axis of hand grip 12, causing the ball to frequently be misdirected. However, since sweet spot 20 is located in the lower portion of racket head 18, it undergoes minimal deflection and the string surface therein tends to remain parallel to the hand grip resulting in proper control over the direction of ball travel. Also, since the upper portion of racket head 18 experiences greater deflection than the lower portion, impact of the ball with the upper portion induces vibration within the racket head, minimizing transfer of rebound force to the ball while inducing unpleasant vibrations within the hand grip. Within sweet spot 20, vibration is minimal; hence, a greater rebound force is transmitted to the ball while transmitting little or no vibration to the hand grip.

Figure 2:
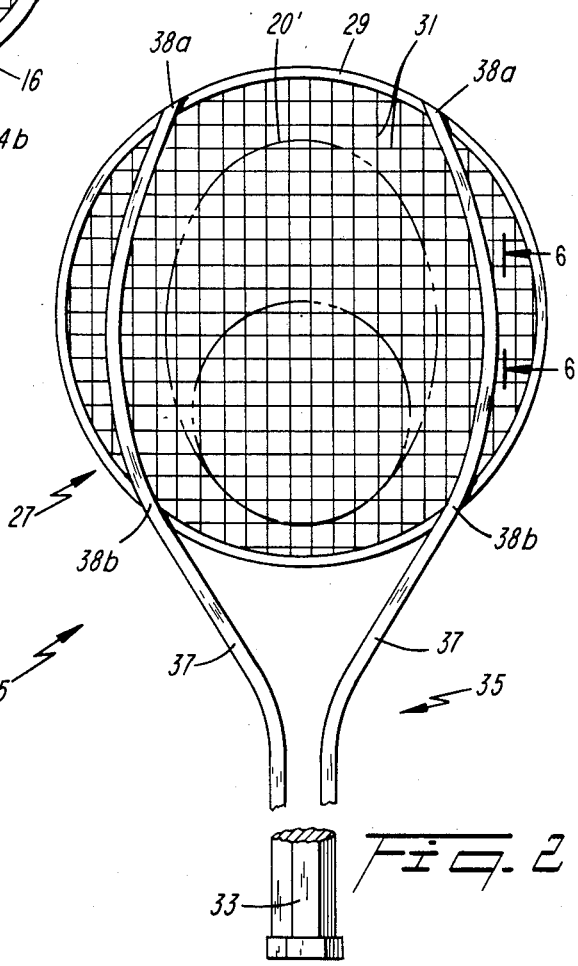
FIG. 2 is a front view of a first embodiment of a sports racket in accordance with the present invention.

To enlarge sweet spot 20 to provide greater controllability while imparting maximum rebound force to the ball, a racket 25 in accordance with the present invention includes a racket head 27 defined by a circular or oval first frame 29 into which plural longitudinal and transverse strings 31 are strung to form a ball-engaging surface on each face of the racket. The racket head 27 is secured to hand grip 33, as shown in FIG. 2, by a second frame 35 formed with the hand grip. The second frame 35 includes first and second frame arms 37 projecting outward from the hand grip. Each frame arm 37 has an upper point of connection 38*a* and a lower point of connection 38*b* with first frame 29. The first and second points of connection 38*a*,38*b*, as best depicted in FIG. 4, cantilever the racket head 27 to hand grip 33 in a manner causing maximum deflection of the racket head to occur (in response to impact with a ball) in the center of the racket.

Figure 6:
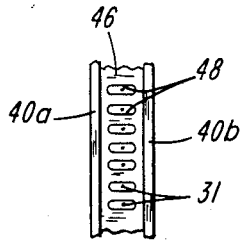
FIG. 6 is a sectional view taken along the line 6—6 of FIG. 2.
Figure 3:
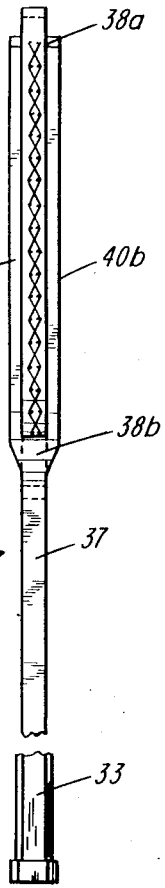
FIG. 3 is a side view of the sports racket of FIG. 2.

As shown in FIG. 3, each frame arm 37, between connection points 38*a*,38*b*, is formed with upper and lower frame members 40*a* and 40*b* extending respectively, in juxtaposed relation to each other, above and below opposite faces of the racket. These upper and lower frame members 40*a*,40*b* are preferably welded to first frame 29 at connection points 38*a*,38*b* and are connected together with a web portion 36 extending through the plane of the string surface. As depicted in FIG. 6, the web portion 46 includes a series of slots 48 elongated in a direction perpendicular to the string surface and spaced to receive both longitudinal and transverse strings 31 passing through the slots.

Figure 4:
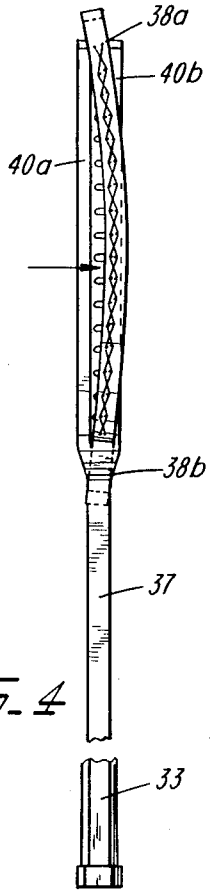
FIG. 4 is a side view similar to FIG. 3 showing deflection of the racket head upon impact of a ball with the string surface.

As mentioned briefly above, second frame 35 results in improved cantilevering of racket head 27 in comparison with racket 10 depicted in prior art FIG. 1, by controlling deflection of first frame 29 so that maximum deflection occurs in the center of the racket (see FIG. 4). The resulting deflection which tends to be symmetrical with respect to the center of the string surface results in an enlarged sweet spot 20′ (in comparison with sweet spot 20) for improved controllability over ball direction while imparting a greater rebound force to the ball for increased power. The slots 48 formed in web portion 46 permit the strings to deflect upon impact with the ball so that the second frame does not impede the deflection of the string surface for transmission of power to the ball, i.e., the strings move through the slots.

Figure 5:
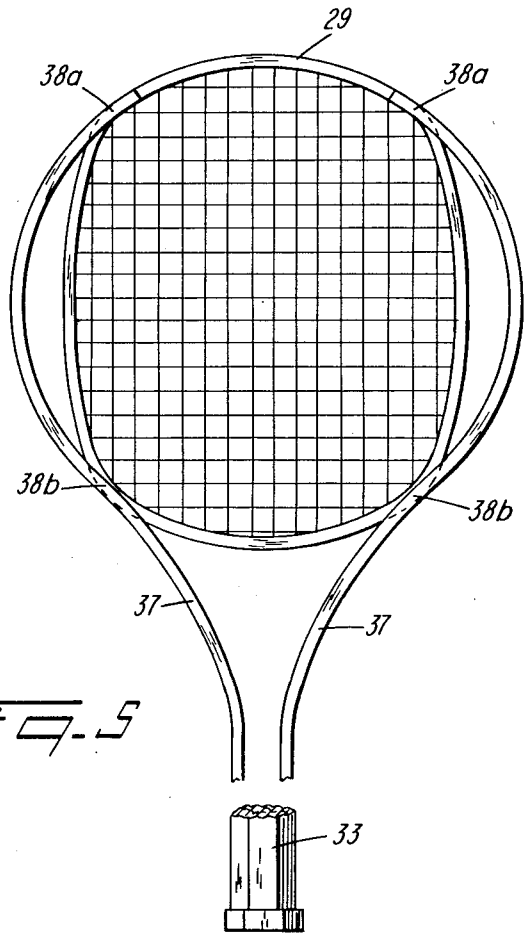
FIG. 5 is front view of a second embodiment of a sports racket in accordance with the present invention.

FIG. 5 is an illustration of a second embodiment of the invention wherein the upper and lower frame portions of each frame arm extend outside the racket head to cantilever the head to hand grip 33 at connection points 38*a*,38*b*. In the embodiment depicted in FIG. 5, the upper and lower frame members need not have the configuration depicted in FIG. 3 and may be formed, for example, as extensions of frame arms 37 having the same cross-sectional configuration.

The foregoing description of a preferred embodiment of the invention has been presented for purposes of illustration and description. It is not intended to be exhaustive or to limit the invention to the precise form disclosed. Obvious modifications or variations are possible in light of the above teachings. The embodiments were chosen and described in order to best illustrate the principles of the invention and their practical application to thereby enable one with ordinary skill in the art to best utilize the invention and various embodiments and with various modifications as are suited to the particular use contemplated. It is intended that the scope of the invention be defined by the claims appended hereto.

I claim:

1. A sports racket for playing tennis and the like, comprising a first frame defining a racket head; plural transversely and longitudinally extending strings mounted within and connected to said first frame to form a strung grid having a ball-engaging surface on each face of the strung grid; and a second frame connected to said first frame and being formed with a hand grip and first and second frame arms projecting outward from the hand grip, each first and second frame arm respectively having only two points of connection with said first frame, the points of connection of each arm being located respectively at upper and lower portions of the first frame relative to a plane perpendicular to the plane defined by said strung grid and transverse to the longitudinal axis of the racket, said points of connection being substantially rigid connections such that portions of the first frame at said points of connection are substantially immovable in relation to portions of said first and second frame arms at the respective points of connection.

2. The racket of claim 1, wherein said points of connection are formed by welding the first frame constituting the racket head to the first and second frame arms.

3. The racket of claim 1, wherein said first and second frame arms, between their respective points of connection with the first frame, extend and are bowed outward from said first frame.

4. A sports racket from playing tennis and the like, comprising a first frame defining a racket head; plural transversely and longitudinally extending strings mounted within and connected to said first frame to form a strung grid having a ball-engaging surface on each face of the strung grid racket; and a second frame connected to said first frame and being formed with a hand grip and first and second frame arms projecting outward from the hand grip, each first and second frame arm respectively having two points of connection with said first frame, the points of connection of each arm located respectively at upper and lower portions of the first frame relative to a plane perpendicular to the plane defined by said strung grid and transverse to the longitudinal axis of the racket; said first and second frame arms, between their respective points of connection with the first frame, each comprising upper and lower frame members extending respectively above and below the plane defined by said strung grid; said first and second frame members, between their respective points of connection with the first frame, being positioned inwardly of the first frame towards said strung grid.

5. The racket of claim 4, further including means, located between each pair of upper and lower frame members, for permitting the strings to pass transversely and longitudinally between and without substantially contacting said upper and lower members.

6. The racket of claim 5, wherein associated upper and lower frame members are formed integral with each other and connected together by a web portion extending through the plane of the string surface, said means being a series of string receiving slots elongated in a direction perpendicular to the plane of the string surface, whereby in response to contact during play between a ball and the sweet zone, said first frame is permitted to flex and bow outwardly from the plane of the second frame with the plane of the string surface remaining generally parallel to and spaced from the plane of the second frame by unimpeded movement of the strings through the slots.

* * * * *